United States Patent [19]

Shay

[11] 4,313,568

[45] Feb. 2, 1982

[54] FLUID DISPENSER METHOD AND APPARATUS

[75] Inventor: Joseph J. Shay, Manchester, N.H.

[73] Assignee: Ethyl Products Company, Richmond, Va.

[21] Appl. No.: 153,770

[22] Filed: May 27, 1980

[51] Int. Cl.[3] ..... B65D 47/34

[52] U.S. Cl. ..... 239/333; 222/380; 222/496; 239/494; 239/533.1

[58] Field of Search ..... 239/333, 452, 453, 456, 239/458, 459, 464, 492, 493, 495, 497, 533.1, 533.13–533.15, 570; 222/380, 494, 496, 520, 385

[56] References Cited

U.S. PATENT DOCUMENTS

| | | | |
|---|---|---|---|
| 3,437,270 | 4/1969 | Venus, Jr. | 239/533.13 X |
| 3,685,739 | 8/1972 | Vanier | 239/333 |
| 3,840,157 | 10/1974 | Hellenkamp | 222/385 X |
| 3,843,030 | 10/1974 | Micallef | 239/478 X |
| 3,967,765 | 7/1976 | Micallef | 239/478 X |
| 4,161,288 | 7/1979 | McKinney | 239/333 |
| 4,249,681 | 2/1981 | French | 239/452 X |

*Primary Examiner*—Andres Kashnikow

*Attorney, Agent, or Firm*—Donald L. Johnson; John F. Sieberth; Edgar E. Spielman, Jr.

[57] ABSTRACT

A nozzle for fitment to hand actuated liquid pumps having a barrel portion with a bore therethrough for passage of a liquid is disclosed. The nozzle features an integrally formed nozzle cap which is mounted to the barrel and which encloses an integrally formed sealing structure. The sealing structure provides a peripheral seal to provide a liquid-tight seal around the barrel between the nozzle cap and the barrel. The sealing structure also provides a check valve portion which is movably positioned at the mouth of the bore. The check valve is biased to form a liquid-tight bore seal. This bore seal is overcome by liquid pressure which builds in the bore upon actuation of the pump. Also provided is a spray member which is fittable within the nozzle cap and which is in abutment with the end wall of the nozzle cap. The spray member, along with the wall of the nozzle cap which it abuts, form a path for the liquid as it is dispensed, which path will cause the liquid to break up and form a spray pattern.

19 Claims, 7 Drawing Figures

FLUID DISPENSER METHOD AND APPARATUS

BACKGROUND OF THE INVENTION

Aerosol dispensers, which are widely used in the packaging industry, present two major problems, atmospheric pollution from the propellant and disposal of the cannister without the risk of explosion and the accompanying hazard to personal safety. The use of hand actuated pump dispensers as a substitute for aerosol dispensers obviates these problems.

Typical pump dispensers presently on the market incorporate a manually operable reciprocating pump mechanism as part of a screw-on closure for a container so that the dispenser may be removed from the container for refilling the container. Such dispensers may have a trigger member, plunger or other protruding element which is intended to be moved manually to operate a pump piston in the dispenser, usually against the force of a return spring, so that liquid may be pumped from the container and dispensed through the liquid ejection nozzle or outlet of the device.

To meet consumer demands for convenience it has been found highly desirable that the nozzle be adjustable to provide widely varying discharge patterns, i.e. a spray pattern and a stream pattern. Exemplary of such nozzles are the ones described in U.S. Pat. Nos. 3,843,030, 3,967,765 and 3,685,739. Since it is also highly desirable that the dispensers should have the ability to be attached to the container for shipment, it is mandatory that the dispenser be capable of acting as a liquid-tight closure for the container during shipment. This liquid-tight characteristic should be present even if the container is tipped over on its side and remains in such position for a long period of time. To achieve this characteristic the dispensers disclosed in the above-mentioned patents all have an "Off" position which is designed to close off the nozzle opening to prevent leakage therethrough. However, the consumer is not always that observant and will, on many occasions, leave the nozzle in the "Spray" or "Stream" position which will result in the nozzle being open to leakage should the container be tipped over. Also, it is possible that leakage could occur should the nozzle be inadvertently packaged in a position which places the containers upside down or on their sides.

The answer to this problem is to provide the dispenser with a static seal which is not dependent upon whether or not the dispenser nozzle is in an open or closed position. A highly useful dispenser design which provides such structure is described in U.S. Pat. No. 4,161,288. This structure is capable of providing multiple dispensing patterns and is capable of maintaining a liquid-tight seal at the nozzle irrespective of whether or not the nozzle is adjusted to the open or closed position. This design, however, is not without certain drawbacks. Referring to the disclosure in this patent, it is seen that a flexible nozzle check valve is provided which fits onto the nozzle barrel and closes the pump bore off. Due to the valve design and the fact that the valve is of an elastomeric material, e.g. thermoplastic rubber, the pump bore is sealed off when there is no fluid pressure applied against the nozzle check valve through the pump bore. In this mode the situation is static and no leakage is possible through the bore even should the container be tipped over. To dispense the product the liquid-tight seal made by the nozzle check valve is broken by the force of the fluid being pumped through the bore and against the valve. Since the valve is made of elastomeric material, it is able to expand out in response to such force and allow the fluid to be dispensed. When the fluid pressure is relieved, such as at the end of the pumping stroke, the nozzle check valve can return to its seated position sealing off the pump bore. But because of the necessity of using an elastomeric material for the valve, difficulty is encountered when the product to be dispensed is such that it interacts with the elastomeric material and causes the nozzle valve to lose its elastic quality or to swell. Exemplary of products which have been found to have adverse reactions with elastomeric materials are petroleum distillates, hydrocarbon solvents, etc. Thus, even though the dispenser shown in U.S. Pat. No. 4,161,288 has many advantages and is capable of providing a multipattern dispensing mode and is able to achieve static sealing of the pump bore, it is still incapable of handling materials which react adversely with the nozzle check valve.

Therefore it is an object of the present invention to provide a nozzle system which is usable on manually operated reciprocating dispensing pumps, which has spray and shut-off modes, which is capable of achieving a static seal over the pump bore, and which is capable of handling products not manageable by present-day elastomeric materials.

THE INVENTION

This invention relates to a nozzle fittable to hand actuated liquid pumps having a barrel portion with a bore therethrough for the passage of liquid. Exemplary of such pumps are the ones disclosed in U.S. Pat. Nos. 3,685,739, 3,840,157 and 4,161,288. The nozzle of this invention is usable on other pump configurations, the only requirement being that the liquid pumped through the bore must be pumped at a pressure sufficient to operate the check valve and achieve the desired spray pattern.

The nozzle of this invention has, as one of its parts, an integrally formed nozzle cap. The cap mounts to the end of the pump barrel and has an end wall having a planar inside wall with an aperture therethrough for passage of the liquid from the bore as it is dispensed. A disc having holes radially displaced from its center is provided. The holes are in communication with channels on the other side of the disc which channels converge at a central point over the aperture in the nozzle cap. The disc is placed in the nozzle cap so that the channels abut the planar inside wall of the nozzle cap to provide a path for the liquid as it is dispensed. This path causes the liquid to break up into a fine spray.

Enclosed by the nozzle cap is an integrally formed sealing structure which is attached to the end of the barrel. The sealing structure has a peripheral liquid-tight seal portion and a check valve portion. The peripheral liquid-tight seal portion forms a seal around the barrel between the nozzle cap and the barrel. This seal prevents leakage, to the outside, of liquid which is pumped into the space between the nozzle cap and sealing structure.

The check valve portion is movably positioned at the mouth of the bore. The check valve has a seal member which selectively forms a liquid-tight bore seal at the bore mouth to close off the flow of liquid through the bore. The check valve portion also has a spring member connected to the seal member whereby the spring member biases the seal member to form its liquid-tight bore seal. While the spring member has sufficient strength to achieve this liquid-tight bore seal it does not have sufficient strength to maintain this seal against liquid pressure which builds in the bore as the pump is actuated. Upon actuation of the pump, therefore, the liquid-tight bore seal is opened thereby allowing liquid to pass through the bore to the aperture in the end wall of the nozzle cap.

The components of the nozzle of this invention, due to their unique configuration and to their relationship with one another, do not require the use of elastomeric material but rather can be made of a thermoplastic such as polyethylene or polypropylene. Since polyethylene and polypropylene have a high resistance to damage or swelling by various hydrocarbons and/or solvents the nozzle of this invention can maintain fidelity of operation even when these materials are dispensed by the pump.

The nozzle of this invention has a shut-off mode and a spray dispensing mode. The shut-off mode is effected by moving the nozzle cap so that the inside surface of the end wall presses against the check valve portion to prevent its movement from the end of the bore. The spray mode is achieved by moving the nozzle cap away from the bore to allow movement of the check valve portion away from the bore. Upon actuation of the pump the check valve portion will be urged forward of the bore until the liquid-tight bore seal is broken thereby allowing the liquid to be forced through the holes in the disc and through the path provided by the channels. When the pressure is relieved, at the end of the dispensing stroke, the check valve portion moves back to achieve the liquid-tight bore seal.

The structure for mounting the nozzle cap to the pump barrel is preferably a helical thread on the nozzle cap which is in cooperation with a helical thread carried by the barrel. By utilizing helical threads it is thus easy to position the nozzle cap at any selected distance from the check valve portion and the pump bore.

These and other features of this invention contributing satisfaction in use and economy in manufacture will be more fully understood from the following description of a preferred embodiment and the accompanying drawings in which identical numerals refer to identical parts and in which.

Figure 1:
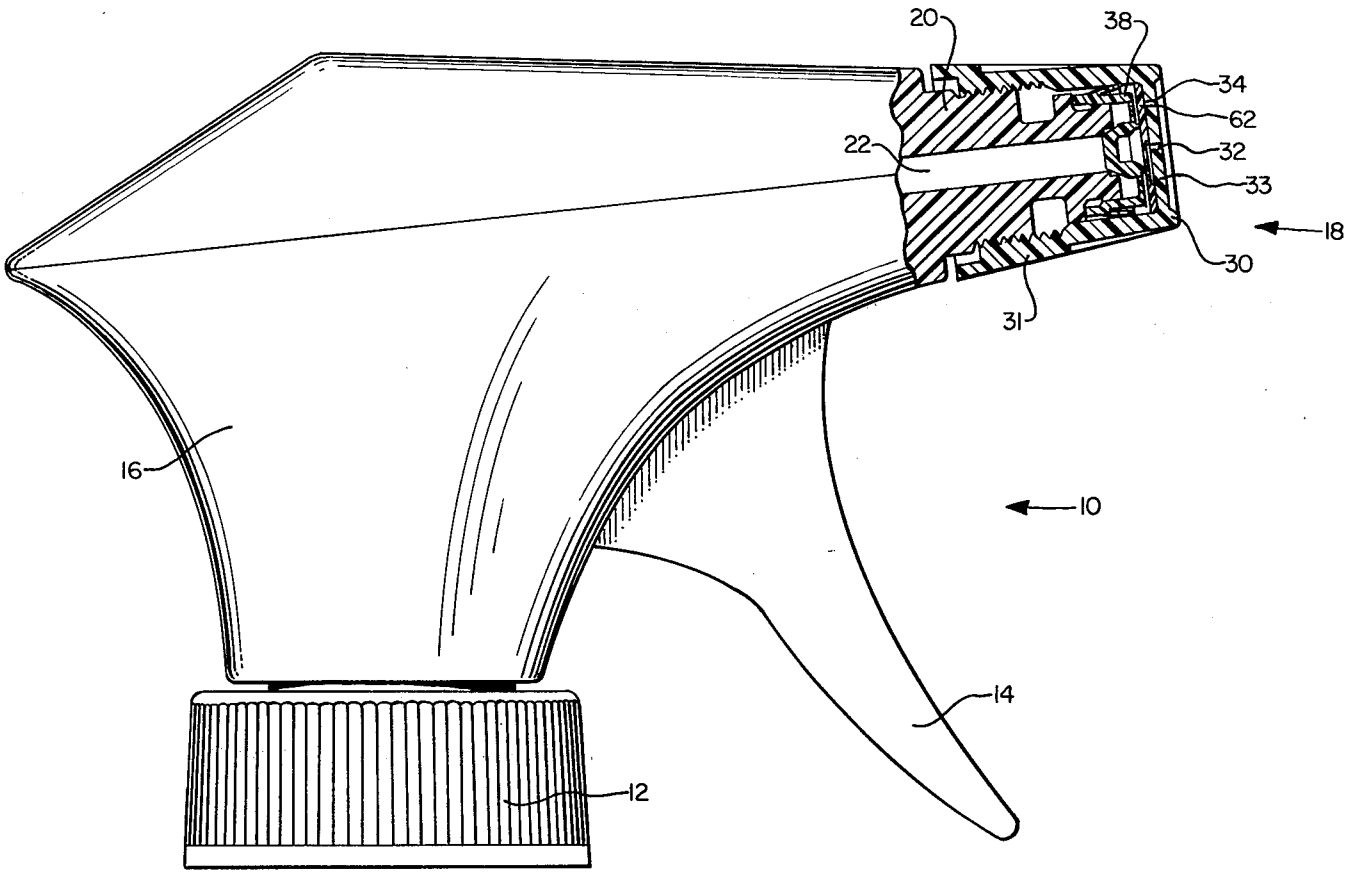
FIG. 1 is a partially broken away side elevational view of a nozzle of this invention attached to a hand actuated pump.

In FIGS. 1–7 there can be seen a nozzle of this invention, generally designated by the numeral 18. The nozzle is affixed to a hand-actuated pump, generally designated by the numeral 10. Pump 10 is affixed to a container by means of pump closure cap 12. Closure cap 12 forms a liquid-tight seal with the container so that the contents of the container cannot leak out should the container be tipped over. Pump housing 16 encloses the pumping mechanism for pumping the liquid from the container upon actuation of pump trigger 14. The particular design of the pump mechanism is not critical to the operation of the nozzle of this invention as long as sufficient liquid pressure is provided upon actuation of the pump to operate the nozzle parts as hereinafter described.

Nozzle 18 is affixed to the barrel of the pump, indicated by the numeral 20. Barrel 20 has a helical thread 21 which cooperates with nozzle cap thread 36 for affixing nozzle 18 to the pump. Nozzle 18 has three component parts, a nozzle cap 30, a seal structure 38 and a spray forming disc 62. Nozzle cap 30 has a nozzle cap end wall 33 with a dispensing aperture therethrough. There is provided a planar inside surface 34 on the inside of nozzle cap end wall 33. Inside surface 34 surrounds dispensing aperture 32. Integrally formed with nozzle cap end wall 33 is nozzle cap skirt 31. This skirt carries the afore-described nozzle cap thread 36.

Figure 2:
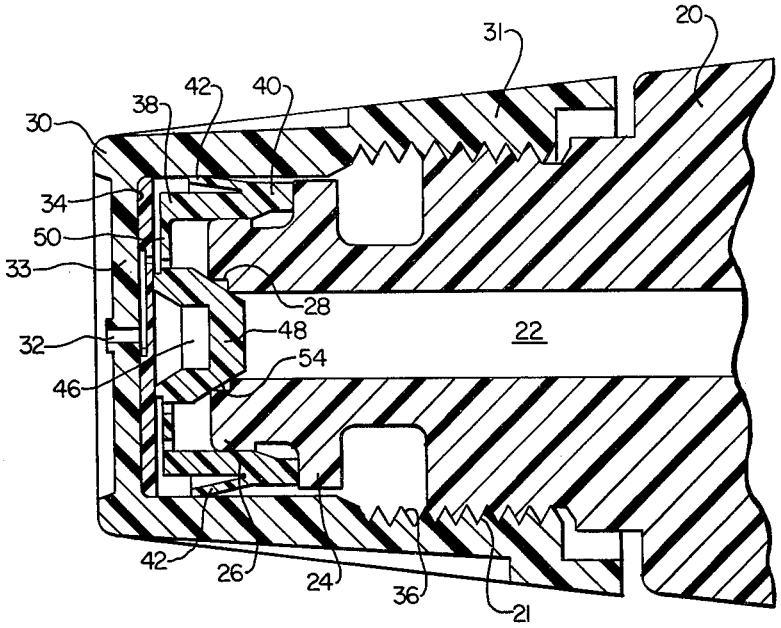
FIG. 2 is a sectional side elevational view of the nozzle shown in FIG. 1 with the nozzle in the closed position.
Figure 3:
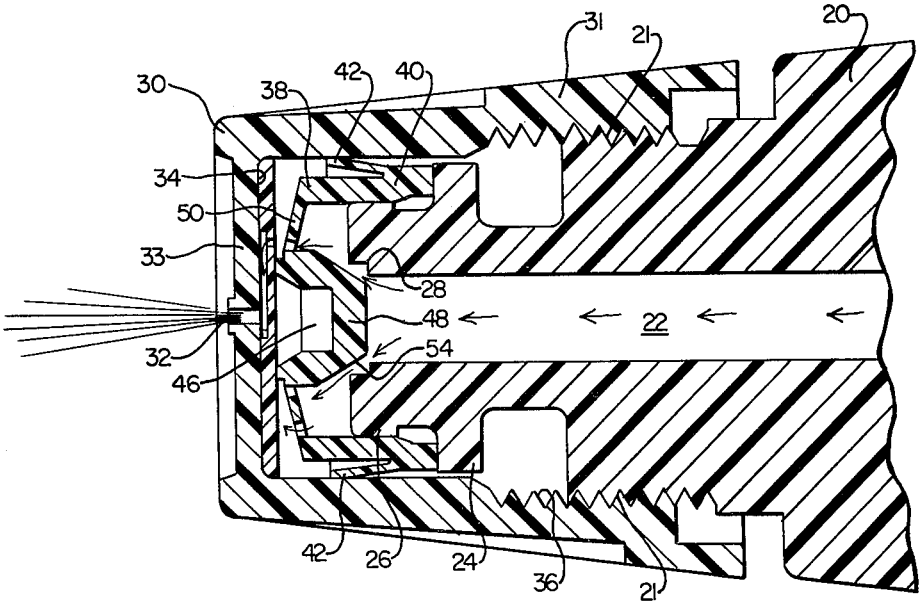
FIG. 3 is a sectional side elevational view of the nozzle shown in FIG. 1 with the nozzle in the spray position.
Figure 4:
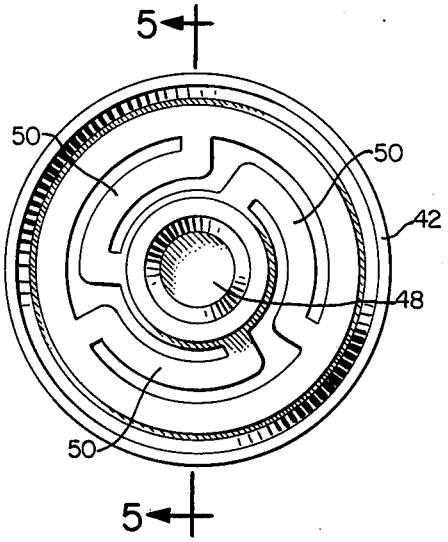
FIG. 4 is a front elevational view of the sealing structure shown in FIG. 1.
Figure 5:
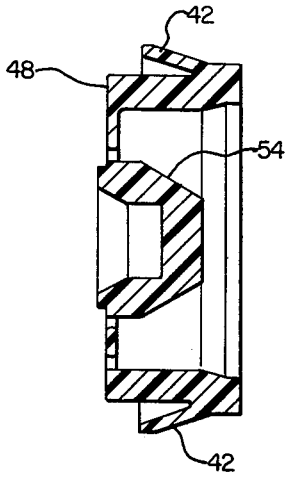
FIG. 5 is a sectional view of the sealing structure taken along section line 5—5 of FIG. 4.

Nozzle cap 30 encloses seal structure 38. Seal structure 38 is mounted to the end of barrel 20 by means of a friction fit over collar 26 which is located at the end of barrel 20. Achieving the precise location of seal structure 38 with respect to the end of barrel 20 is accomplished by means of annular collar 24 which is an integral part of barrel 20. This collar acts as a stop structure for positioning seal structure 38. Seal structure 38 is integrally formed and has a peripheral seal portion 40 and a check valve portion 46. To achieve the peripheral liquid-tight seal function required of seal portion 40 there is provided sealing lip 42. Sealing lip 42 is dimensioned to achieve a peripheral liquid-tight engagement with nozzle cap 30 as is seen in FIGS. 1–3. Sealing lip 42 therefore prevents leakage between barrel 20 and nozzle cap 30. Other sealing arrangements, of course, may be utilized, the one utilized by the embodiment shown in the drawings being a preferred configuration.

Check valve portion 46 has a seal member 48 and a spring member 50. Seal member 48 preferably provides a conical surface 54 which co-acts with annular groove 28 at the mouth of bore 22 to provide an openable and closeable liquid-tight seal. Connected adjacent the distal end of conical surface 54, as can be seen in FIGS. 2–5, is spring member 50. For the embodiment shown spring member 50 comprises three arcuate segments which are dimensioned to be sufficiently resilient to provide the necessary spring function as hereinafter described.

Figure 6:
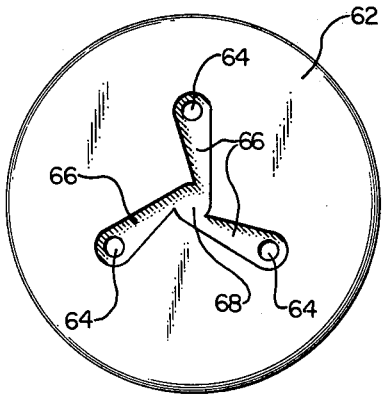
FIG. 6 is a front elevational view of the disc shown in FIG. 1.
Figure 7:
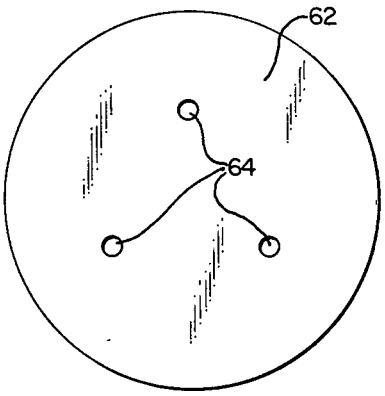
FIG. 7 is a rear elevational view of the disc shown in FIG. 1.

Disc 62, as can be seen in detail in FIGS. 6 and 7, has three holes 64 therethrough. These holes each intercept a channel 66 in the other side of disc 62. Channels 66 converge at a central point 68 which is located opposite aperture 32. The particular configuration of the channels shown in the drawings is a preferred design. However, many other configurations well known to those skilled in the art may be used to provide the "swirl chamber" effect needed to break up the liquid to yield a spray pattern.

The nozzle of this invention has, as before stated, a shut-off mode and a spray mode. In the shut-off mode, shown in FIG. 2, passage of liquid through bore 22 is prevented even if the pump is actuated as check valve portion 46 is blocked from the movement which would open the liquid-tight bore seal as the inside face of nozzle cap 30 is pressing tightly against check valve portion 46. In the spray mode check valve portion 46 would be free to move under the urging of liquid pressure in bore 22 upon pump actuation.

To achieve the spray mode of operation, nozzle cap 30 is loosened until it is displaced a distance away from check valve portion 46 so that seal member 48 is able to move and thus open the liquid-tight bore seal between conical surface 54 and annular groove 28. This mode is shown in FIG. 3. With nozzle cap 30 in the spray position the pump is actuated by pulling trigger 14. Liquid pressure builds in bore 22 until it is sufficient to overcome the spring bias provided by spring member 50. Once the spring bias has been overcome, seal member 48 moves to open the liquid-tight bore seal and thus allows the pumped liquid to be forced through channels 66 and out aperture 32. After a charge of liquid has been dispensed pump trigger 14 is released. Upon trigger release, seal member 48 returns to the seal position to provide a liquid-tight bore seal at the urging of spring member 50. In some prior art pumps, e.g. U.S. Pat. No. 3,685,739, closing off of the bore after liquid has been dispensed relies upon the creation of a partial vacuum carried by the pump during its loading cycle. With these types of pumps there is a period of time before the bore can be closed off that air is sucked into the bore and into the pump chamber. This is disadvantageous as the sucked in air displaces liquid in the pump chamber and thus the subsequent charge of liquid will be of a reduced quantity. However, for the nozzle of this invention, the return of seal member 48 to the seal position is effected by spring action means which is acting against liquid in bore 22. Thus there is a very little, if any at all, amount of air being sucked into the bore. By keeping air out of the bore a full charge of liquid is assured in the pump chamber.

What is claimed is:

1. A nozzle for fitment to hand actuated liquid pumps having a barrel portion with a bore therethrough for passage of liquid, said nozzle comprising:

a. an integrally formed nozzle cap which includes
   i. an end wall having a planar inside wall and an aperture through said planar wall through which liquid from said bore is dispensed, and
   ii. a skirt portion having mounting means for mounting said nozzle cap around the end portion of said barrel;

b. an integrally formed sealing means attached to said barrel and enclosed by said nozzle cap, said sealing means having
   i. a peripheral seal portion to provide a liquid-tight seal around said barrel between said nozzle cap and said barrel, and
   ii. a check valve portion movably positioned at the mouth of said bore, said check valve portion including a seal member which selectively forms a liquid-tight bore seal with said mouth of said bore to close off the flow of liquid therethrough, and a spring member in operative relationship with said seal member whereby said spring member biases said seal member to form its said liquid-tight bore seal, but said spring member having a biasing strength sufficiently low to allow liquid pressure in said bore, developed by actuation of said pump, to move said seal member away from said bore so that said liquid-tight bore seal is opened and liquid in said bore can pass to said aperture in said nozzle cap; and c. spray means fittable within said nozzle cap and in abutment with said planar wall, said spray means and said planar wall together providing a path for the liquid as it is dispensed, said path causing said liquid to break up and form a spray pattern.

2. The nozzle of claim 1 wherein said nozzle is made of thermoplastic material.

3. The nozzle of claim 2 wherein said nozzle is made of polyethylene or polypropylene.

4. The nozzle of claim 1 wherein said seal member is a conical surface which abuts the mouth of said bore to form said liquid-tight bore seal and has its center axis congruent with the center axis of said bore.

5. The nozzle of claim 4 wherein said spring member is a plurality of resilient arcuate segments which are connected to said seal member at one of their ends and to the remainder of said check valve portion at the other of their ends.

6. The nozzle of claim 4 wherein there is an annular groove at the mouth of said bore which co-acts with said conical surface to form said liquid-tight bore seal.

7. The nozzle of claim 5 wherein there is an annular groove at the mouth of said bore which co-acts with said conical surface to form said liquid-tight bore seal.

8. The nozzle of claim 4 wherein said nozzle is made of polyethylene or polypropylene.

9. The nozzle of claim 5 wherein said nozzle is made of polyethylene or polypropylene.

10. The nozzle of claim 6 wherein said nozzle is made of polyethylene or polypropylene.

11. The nozzle of claim 4 wherein said nozzle is made of polyethylene or polypropylene.

12. The nozzle of claim 1 wherein said spray means is a disc having a plurality of radially displaced holes therein and having a channel leading from each of said holes to a common point of convergence.

13. The nozzle of claim 12 wherein said nozzle has a shut-off mode and a spray mode and wherein, i. said shut-off mode is effected by moving said nozzle cap so that said planar inside surface presses against said planar face to prevent movement of said check valve portion, and ii. said spray mode is effected by moving said nozzle cap so that said planar inside surface is a distance displaced from said planar face so that said check valve portion can move to open said liquid-tight bore seal.

14. The nozzle of claim 13 wherein said mounting means is a helical thread for cooperation with a helical thread carried by said barrel.

15. The nozzle of claim 13 wherein said nozzle is made of thermoplastic material.

16. The nozzle of claim 13 wherein said nozzle is made of polyethylene or polypropylene.

17. The nozzle of claim 15 wherein said seal member is a conical surface which abuts the mouth of said bore to form said liquid-tight bore seal and has its center axis congruent with the center axis of said bore.

18. The nozzle of claim 17 wherein said spring member is a plurality of resilient arcuate segments which are connected to said seal member at one of their ends and to the remainder of said check valve portion at the other of their ends.

19. The nozzle of claim 17 wherein there is an annular groove at the mouth of said bore which co-acts with said conical surface to form said liquid-tight bore seal.

* * * * *